United States Patent [19]

Shimasaki

[11] Patent Number: 4,856,246

[45] Date of Patent: Aug. 15, 1989

[54] TILE ASSEMBLY

[75] Inventor: Shigetaka Shimasaki, Tokyo, Japan

[73] Assignee: Nihon Kenkou K.K., Tokyo, Japan

[21] Appl. No.: 140,204

[22] Filed: Dec. 31, 1987

[30] Foreign Application Priority Data

Apr. 17, 1987 [JP] Japan ..... 62-58247[U]

[51] Int. Cl.[4] ..... E04F 13/08

[52] U.S. Cl. ..... 52/386; 52/387

[58] Field of Search ..... 52/384, 386, 387

[56] References Cited

U.S. PATENT DOCUMENTS 1,946,690 2/1934 Haines ..... 52/386

2,022,363 11/1935 Vertuno ..... 52/386

2,082,241 6/1937 Bennett ..... 52/387

FOREIGN PATENT DOCUMENTS 2125081 2/1984 United Kingdom ..... 52/386

*Primary Examiner*—David A. Scherbel

*Assistant Examiner*—Creighton Smith

*Attorney, Agent, or Firm*—Takeuchi Patent Office

[57] ABSTRACT

A tile assembly comprising a tile support plate having a plurality of vertical brackets erected at right angles and provided with a hook portion and a plurality of tiles having on its backside a groove with an upper engaging edge for engaging at least a pair of the hook portions, thereby securing the tile to the support plate.

2 Claims, 2 Drawing Sheets

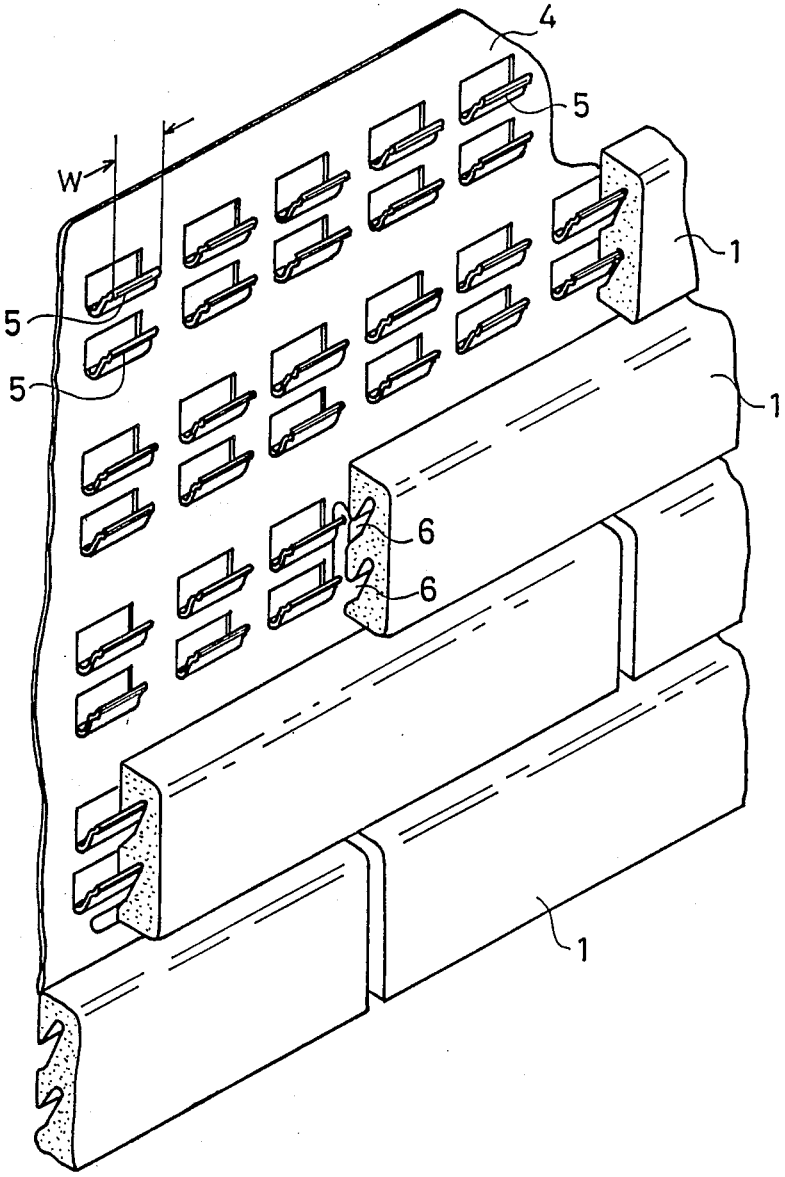
FIG. 3
PRIOR ART
FIG. 4
PRIOR ART
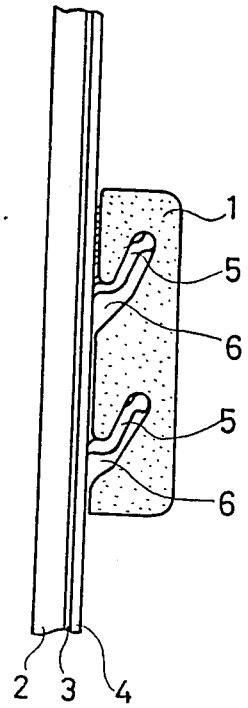

TILE ASSEMBLY

BACKGROUND OF THE INVENTION

The present invention relates to a tile assembly consisting of a tile support plate and a plurality of tiles mounted on the support plate.

FIGS. 3 and 4 show a conventional tile assembly in which a tile 1 is mounted on a tile support plate 4 secured to a wall 2 via a waterproof sheet 3. The tile support plate 4 has a plurality of laterally brackets 5 each having a width of W and a substantially L-shaped cross section. A pair of engaging grooves 6 are provided on the backside of a tile 1 to receive a certain number of lateral brackets 5 for securing the tile 1 to the support plate 4.

When the support plate 4 is to be cut along a vertical line at the end of a wall, the lateral brackets 5 having a width of W can be on the line, making the cutting operation very difficult. In addition, the angle between the lateral brackets 5 and the support plate 4 is liable to change during storage of handling, making it difficult to snap a tile over deformed lateral brackets. When L-shaped tiles are used at an edge or corner of two walls, it is impossible to use the lateral brackets 5 so that they must be cut off and only adhesive can be used.

SUMMARY OF THE INVENTION

Accordingly, it is an object of the invention to provide a tile assembly including a tile support plate which has a large tile holding power and is easy to cut and mount.

In order to achieve the above object, a groove with a pair of engaging edges is provided on the backside of a tile and a plurality of vertical brackets with an inclined upper edge for engaging the engaging edge are provided on the support plate.

Since the vertical brackets extend in the vertical direction, they will hardly interfere with the cutting of the support plate along a vertical line. They are erected at right angles to the support plate 10 and are sufficiently strong to resist against deformation and support the weight of tiles. It is also easy to mount a tile on the vertical brackets. The L-shaped tiles for use in an edge or corner of a building are able to mount without difficulty.

Other objects, features, and advantages of the invention will be apparent from the following description when taken in conjunction with the accompanying drawings.

BRIEF DESCRIPTION OF THE DRAWING

FIG. 3 is a perspective view of a conventional tile assembly; and

FIG. 4 is an enlarged side view of part of the conventional tile assembly of FIG. 4.

DESCRIPTION OF THE PREFERRED EMBODIMENTS

Figure 1:
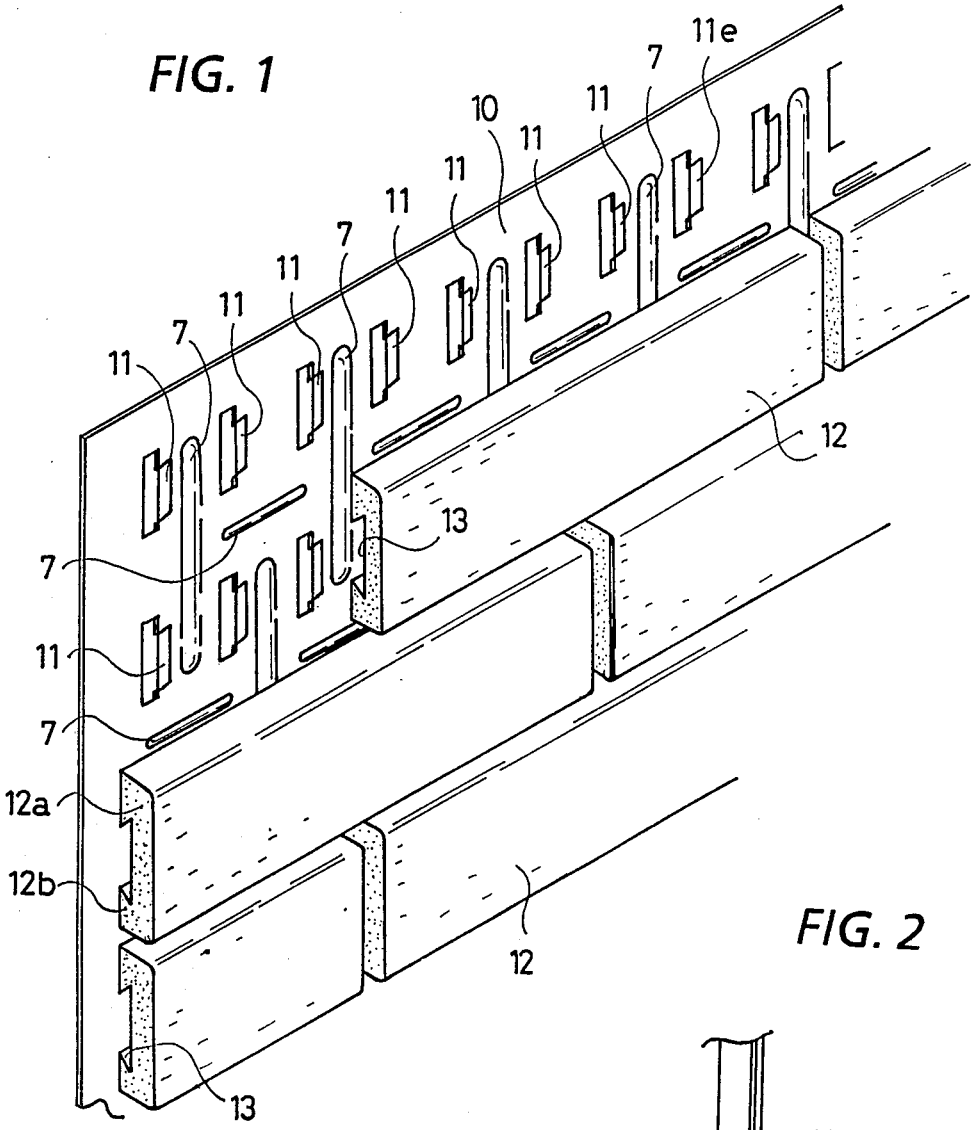
FIG. 1 is a perspective view of a tile assembly according to an embodiment of the invention.
Figure 2:
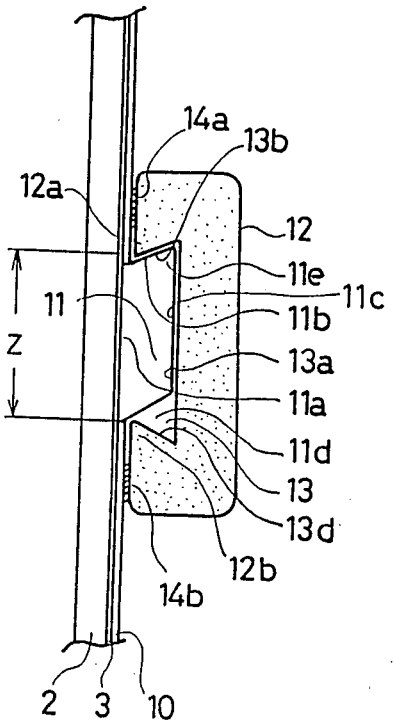
FIG. 2 is an enlarged side view of part of the tile assembly of FIG. 1.

FIGS. 1 and 2 show a tile assembly according to an embodiment of the invention which includes a tile support plate 10 having a plurality of vertical brackets 11.

The vertical bracket 11 is erected at right angles to the support plate 10 and extends in the vertical direction. It is made in the form of a parallelogram with a base side 11*a*, an opposing vertical side 11*c*, and a pair of parallel upper and lower sides 11*b* and 11*d* inclined upwardly from the base side. The upper side 11*b* constitutes a hook portion 11*e*. The vertical brackets 11, each formed by cutting out of the support plate 10 and bending 90 degrees towrad tiles 12, are aligned in rows and columns on the support plate 10.

A grove 13 is provided on the backside of a tile 12. The width (Z) of opening of the groove 13 is defined by a pair of upper and lower engaging edges 12*a* and 12*b*. The width of the groove increases with the depth to the bottom 13*a*, forming a trapezoidal cross section with a pair of upper and lower inclined surfaces 13*b* and 13*d*. The inclination of the upper inclined surface 13*b* is made substantially equal to that of the upper side 11*b* of the hook portion 11*e* so that they abut each other with a line rather than a point.

To mount tiles 12 on the tile support plate 10, a tile 12 is mounted in such a manner that the engaging edge 12*a* may engage the hook portions 11*e* of a predetermined number of vertical brackets 11 aligned in a desired row, whereby the tile can be engaged on the inclined surface of the hook portion in either direction. To firmly fasten the tile, it is preferred to use an adhesive 14*b* between the lower part of the tile and the support plate. The upper-part abhesive 14*a* may be omitted.

Since the vertical brackets extend in the vertical direction, the tile support plate may be cut along a vertical line passing through a given point without interference with the brackets, thus increasing the productivity on the construction site. The vertical bracket erected at right angles is made in the best form to resist to deformation and support the weight of tiles and allows easy mounting of tiles. It is also easy to mount L-shaped tiles at an edge or corner of a building.

While a preferred embodiment of the invention has been described using specific terms, such description is illustrative purposes only, and it is to be understood that changes and variations may be made without departing from the spirit and scope of the invention as recited in the appended claims.

What is claimed is:

1. A tile assembly comprising:

a tile support plate having a plurality of vertical brackets each erected at right angles to said tile support plate and extending in the vertical direction so as to form a parallelogram with an upper inclined side and an outer vertical side forming a hook portion and inner vertical side integral with said tile support plate; and a plurality of tiles each having on its backside a dovetailed groove extending in the horizontal direction and provided with an upper engaging edge for engaging at least a pair of said hook portions, thereby securing said tile to said support plate, whereby the tile can be engaged on the inclined surface of the hook portion in either direction.

2. The tile assembly of claim 1, wherein said vertical brackets are aligned in rows and columns on said support plate to support each of said tiles with a predetermined number thereof in each of said rows.

* * * * *